US011708716B2

(12) United States Patent
Leite

(10) Patent No.: US 11,708,716 B2
(45) Date of Patent: Jul. 25, 2023

(54) SECURITY DOOR

(71) Applicant: Travis Lloyd Leite, Sherwood Park (CA)

(72) Inventor: Travis Lloyd Leite, Sherwood Park (CA)

( * ) Notice: Subject to any disclaimer, the term of this patent is extended or adjusted under 35 U.S.C. 154(b) by 0 days.

(21) Appl. No.: 17/021,390

(22) Filed: Sep. 15, 2020

(65) Prior Publication Data

US 2022/0081953 A1 Mar. 17, 2022

(51) Int. Cl.
*E05F 15/00* (2015.01)
*E05F 15/73* (2015.01)
*E05F 15/611* (2015.01)

(52) U.S. Cl.
CPC ..... *E05F 15/73* (2015.01); *E05F 15/611* (2015.01); *E05F 2015/767* (2015.01); *E05Y 2400/45* (2013.01); *E05Y 2400/86* (2013.01); *E05Y 2900/132* (2013.01)

(58) Field of Classification Search
CPC . E05F 15/73; E05F 15/74; E05F 15/75; E05F 15/76; E05F 15/00; E05F 15/611; E05F 2015/767; E05F 15/77; E05F 17/001; E05Y 2400/45; E05Y 2400/86; E05Y 2900/132
USPC ..... 49/31
See application file for complete search history.

(56) References Cited

U.S. PATENT DOCUMENTS

| | | | | |
|---|---|---|---|---|
| 10,281,987 | B1 * | 5/2019 | Yang | G06F 3/04847 |
| 11,073,949 | B2 * | 7/2021 | Otani | G06F 3/04845 |
| 2018/0137638 | A1 * | 5/2018 | Taguchi | H04N 5/23264 |
| 2021/0047874 | A1 * | 2/2021 | Han | E05F 15/73 |
| 2021/0317697 | A1 * | 10/2021 | Tulsidas | G06K 9/00288 |

FOREIGN PATENT DOCUMENTS

| | | | | |
|---|---|---|---|---|
| CN | 106050059 | * | 5/2016 | E06B 7/30 |

* cited by examiner

*Primary Examiner* — Chi Q Nguyen
(74) *Attorney, Agent, or Firm* — Orin Del Vecchio

(57) ABSTRACT

A security door configured to provide controlled access through a doorway wherein the security door of the present invention includes all elements to offer a touch-less entry and further provide compliance with building codes and visual surveillance. The security door of the present invention includes a door member being hingedly mounted on a doorway. The door member includes an integrally mounted controller that is operably coupled to a communications network via a network module and communications cable. The controller is operably coupled to a card scanner module and a switch module that operate to provide verification of an individual and move the door member to an open position. The door member further includes an integrally mounted power supply and at least one camera module wherein the camera module is operable to capture photographic images. A light module and egress module are integrally mounted to the door member.

12 Claims, 1 Drawing Sheet

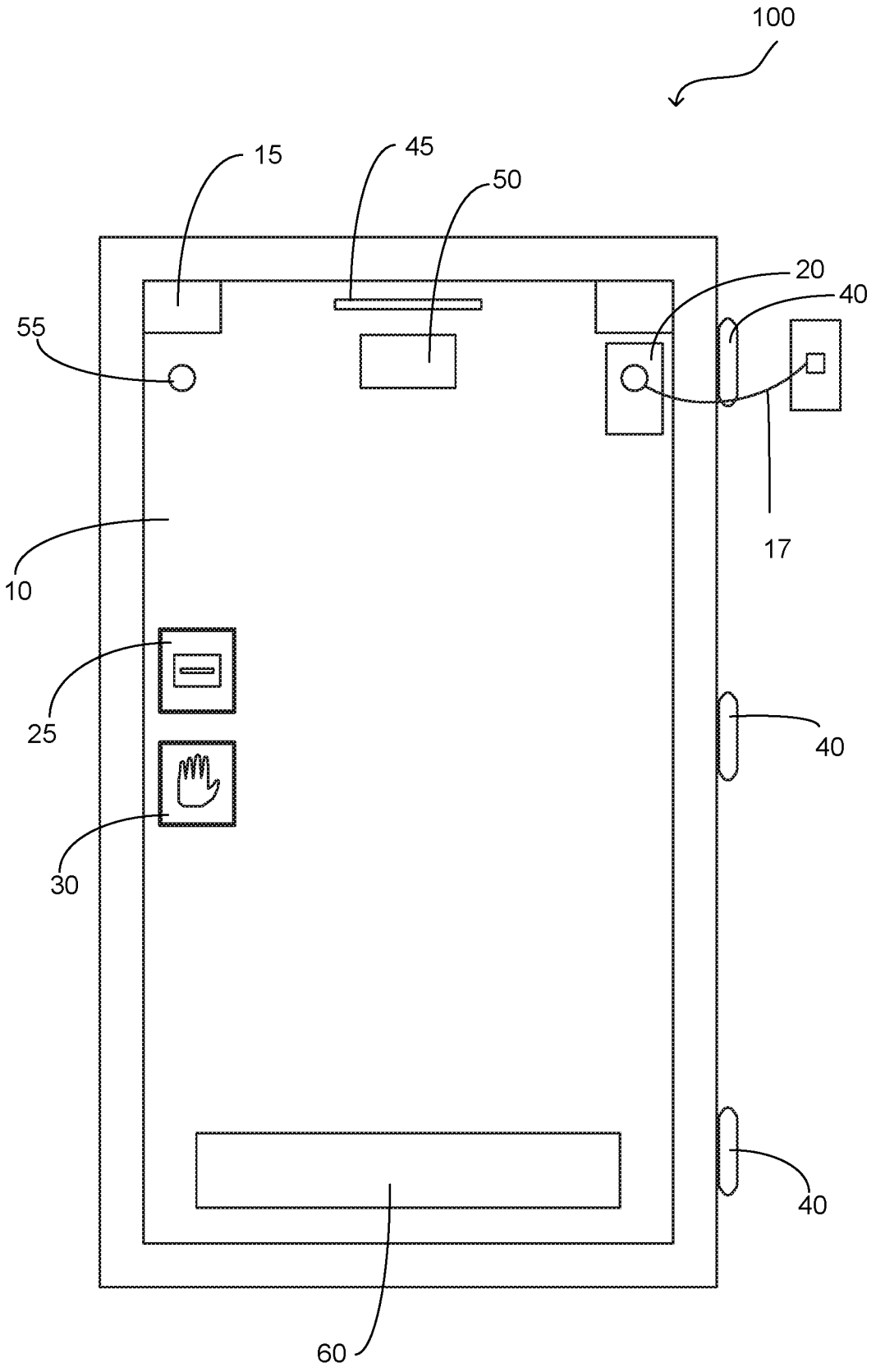
100
15
45
50
20
40
55
17
10
25
40
30
40
60

SECURITY DOOR

FIELD OF THE INVENTION

The present invention relates generally to access doors, more specifically but not by way of limitation, an access door configured to provide security of an entry into a building or a portion thereof wherein the security door of the present invention provides a plurality of elements operable to address security concerns as well as communicable disease protocols.

BACKGROUND

As is known in the art various types of doors are utilized to control access to either a building or an interior portion thereof. Door types range from conventional swing doors, revolving doors and even overhead doors wherein the aforementioned are configured to provide opening and closing of an access into a building or within an interior portion thereof. Most doors are configured with various types of locks such as but not limited to deadbolt locks. Electromechanical or magnet locks are further available and are often utilized in commercial setting such as but not limited to office buildings. It is common for office buildings that have a significant number of employees enter and exit the building for work to employee some type of security feature that is associated with the door. Much of the conventionally available security features utilized include card scanners that are located adjacent to the door and are operably coupled to a lock wherein if a programmed card is placed adjacent to the scanner the scanner will deactivate the lock allowing the person to grasp a handle and enter through the doorway.

As security is of the utmost importance for many commercial facilities, alternate security devices are further deployed to provide additional security. Devices such as but not limited to cameras are typically deployed within the facility. Additionally, building code requirements include but are not limited to emergency exit signs and lights. The aforementioned are not available as part of a door structure and during remodels and other construction projects this results in an increased cost. Furthermore, as recent global pandemics have spread with contagious viruses, it is desirable to further have facility doors that con be operated without having to physically engage to open or close.

It is intended within the scope of the present invention to provide a security door that provides controlled access to a building or an interior portion thereof wherein the door provides an all inclusive solution for security access.

SUMMARY OF THE INVENTION

It is the object of the present invention to provide a security door that is configured to provide controlled access to a building or a portion thereof wherein the security door of the present invention includes an integrated controller wherein the controller is operably coupled to all elements of the security door.

Another object of the present invention is to provide a security door the provides secure access and further is configured for touch-less operation thereof wherein the present invention includes an integrated security card access scanner.

A further object of the present invention is to provide a security door that is configured to provide controlled access to a building or a portion thereof wherein the door includes a non-contact engagement member that is operable to provide an interface for a user to open or close the door.

Still another object of the present invention is to provide a security door the provides secure access and further is configured for touch-less operation thereof that further includes an integrated network module that can be configured to be operably coupled to a computer network.

An additional object of the present invention is to provide a security door that is configured to provide controlled access to a building or a portion thereof wherein the door of the present invention further includes an integrated power supply.

Yet a further object of the present invention is to provide a security door the provides secure access and further is configured for touch-less operation thereof wherein the security door can further include egress lighting as well as emergency signs.

Another object of the present invention is to a provide a security door that is configured to provide controlled access to a building or a portion thereof wherein the door of the present invention further includes at least one security camera.

An alternate object of the present invention is to provide a security door the provides secure access and further is configured for touch-less operation thereof wherein the hinges of the preferred embodiment of the present invention are electromechanical worm gear hinges.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

FIG. 1 is a front diagrammatic view of the present invention.

DETAILED DESCRIPTION

Referring now to the drawings submitted herewith, wherein various elements depicted therein are not necessarily drawn to scale and wherein through the views and figures like elements are referenced with identical reference numerals, there is illustrated a security door 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted as a part hereof, the security door 100 includes a door member 10 wherein the door member 10 is manufactured from a suitable durable material such as but not limited to wood or metal. It should be understood within the scope of the present invention that while the security door 100 is illustrated herein as a conventional swing door that the security door 100 could be constructed in other forms of doors such as but not limited to a revolving door. Integrally mounted in the door member 10 is controller 15. The controller 15 includes the necessary electronics to receive, store, transmit and manipulate data. The controller 15 is operably coupled to all of the elements of the security door 100 discussed further herein so as to provide operation thereof. The controller 15 is communicably coupled to a network utilizing a communication cable 17 wherein the communication cable in a preferred embodiment is a category six communications cable. The communication cable 17 provides the necessary interface for the security door 100 to a communications network in the building. This permits remote operational control thereof as well as a technique to provide sufficient power for door operation. The communication cable 17 is operably coupled to a network module 20 wherein the network module 20 is further operably coupled to the controller 15.

Integrally mounted within the door member 10 is a card scanner module 25. The card scanner module 25 is configured to receive either internally or have placed proximate thereto a security card (not illustrated herein) that is in possession of a person desiring to utilize the security door 100. The card scanner module 25 in a preferred embodiment of the present invention is configured to read either magnetic cards or RFID cards. However, it should be understood within the scope of the present invention that the card scanner module 25 could be configured to be operated utilizing alternate forms of technology. The card scanner module 25 is operably coupled to the controller 15 wherein upon receiving a card the card scanner module 25 will transmit a signal to the controller 15 for verification of entry. In a preferred embodiment of the present invention the card scanner module 25 is further operable to utilize Bluetooth wherein the card scanner module 25 is paired with remote devices such as but not limited to cellular phones. The card scanner module 25 will detect a remote device communicably coupled via Bluetooth and ensuing the remote device being detected within proximity of the door member 10 the remote device pairing will be validated by the controller 15 and as such the individual in possession of the remote device will utilize the switch module 30 to gain entry into the door.

Located beneath the card scanner module 25 is the switch module 30. The switch module 30 is utilized to provide a touch-less technique to open and/or close the door member 10. The switch module 30 is operably coupled to the controller 15 and will receive a signal therefrom permitting opening and/or closing of the door member 10. Subsequent receiving a signal from the controller 15 a user will pass a portion of their hand in front of the switch module 30 wherein the switch module 30 utilizes optical or photo sensors to detect the presence thereof. The door member 10 will then be moved to an open and/or closed position via the hinge members 40. Furthermore, it should be understood that the switch module 30 will operate any locking element (not illustrated herein) such as but not limited to a deadbolt lock. In a preferred embodiment the hinge members 40 are electromechanical worm gear hinges operated by the controller 15 so as to move the door member 10 intermediate a closed and open position. It should be understood within the scope of the present invention that the hinge members 40 could be constructed from alternate types of hinges and achieve the desired function described herein. The switch module 30 provides a touch-less technique of opening and/or closing the door member 10. It should be understood within the scope of the present invention that the card scanner module 25 and switch module 30 could be present on both sides of the door member 10.

The door member 10 further has integrally mounted thereto proximate the top end a light module 45 and an egress sign module 50. Both the light module 45 and egress sign module 50 provide an integrated technique of code compliance. It is a common requirement that emergency lighting and signage are required as part of commercial building code. The light module 45 and egress sign module 50 provide an integrated technique of code compliance that is built into the security door 100. It should be understood that a light module 45 and egress sign module 50 could be present on both sides of the door member 10.

Located proximate the top end of the door member 10 is camera module 55. The camera module 55 is integrally mounted in the door member 10 and is operably coupled to the controller 15. The camera module 55 is configured to capture both still and video images of areas proximate the door member 10 and transfer to the controller 15 which can be accessed from a remote location via the communication cable 17. It should be understood within the scope of the present invention that the door member 10 could have camera modules 55 on both sides of thereof.

Disposed within the door member 10 is a power supply 60. The power supply 60 is a conventional battery pack that is configured to provide operation of the security door 100 in the event of a power failure. The power supply 60 is operably coupled to the controller 15 and it is contemplated within the scope of the present invention that the power supply 60 could provide operation of the security door 100 for at least several days.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A security door installed in a building that is operable to provide controlled access to a doorway and further provide monitoring of an area proximate thereto wherein the security door comprises:

a door member, said door member being operably coupled to a doorway, said door member configured to permit access through the doorway;

a controller, said controller being integrally mounted in said door member, said controller having electronics configured to receive, store, transmit and manipulate data, said controller being communicably coupled to a communications network present in the building wherein the security door is installed;

a switch module, said switch module being present on at least one side of the door member, said switch module being operably coupled to said controller, said switch module configured to provide unlocking of said door member so as to allow said door member to be moved to an open position;

one or more of: a light module, said light module being integrally mounted in said door member proximate a top area of the door member, said light module being operably coupled to said controller and an egress sign module, said egress sign module being integrally mounted in said door member proximate the top area of the door module; and wherein said switch module is configured so as to provide a touch-less operation of the door member by a user.

2. The security door as recited in claim 1, and further including a card access module, wherein the card access module is operably coupled to the controller, said card access module configured to be wirelessly paired to a remote device or operably couple a security card.

3. The security door as recited in claim 2, and further including at least one camera module integrally mounted in said door member, said at least one camera module being communicably coupled to said controller, said at least one camera module operable to capture photographic data of an area proximate the door member.

4. The security door as recited in claim 3, wherein the door member is mounted to the doorway utilizing hinges, said hinges being electromechanical hinges that are operably coupled to said controller.

5. The security door as recited in claim 4, wherein the door member further includes a power supply, said power supply configured to provide power for operation of the security door in an event where power from the building is interrupted.

6. The security door as recited in claim 5, and further including a network module, said network module being integrally mounted in said door member, said network module operably coupled to the communications network in the building via a communications cable.

7. A security door installed in a building wherein controlled access is desirable and further compliance with building safety codes wherein the security door comprises:

a door member, said door member being operably coupled to a doorway, said door member having a first side and a second side, said door member having a top and a bottom, said door member configured to permit access through the doorway;

a controller, said controller being integrally mounted in said door member, said controller having electronics configured to receive, store, transmit and manipulate data, said controller being communicably coupled to a communications network present in the building wherein the security door is installed;

at least one switch module, said at least one switch module being present on at least one side of the door member, said at least one switch module being operably coupled to said controller, said at least one switch module configured to provide unlocking of said door member so as to allow said door member to be moved to an open position;

a card access module, said card access module being mounted to said door member proximate said switch module, wherein the card access module is operably coupled to the controller, said card access module configured to be wirelessly paired to a remote device or operably couple with a security card;

two light modules, said two light modules integrally mounted in said door member proximate the top of said door member, said two light modules being operably coupled to said controller, wherein one of said two light modules is on the first side of the door member and one of said light modules being on said second side of said door member;

two egress sign modules, said two egress sign modules integrally mounted in said door member proximate the top of said door member, said two egress sign modules being operably coupled to said controller, wherein one of said two egress sign modules is on the first side of the door member and one of said egress sign modules being on said second side of said door member; and wherein said switch module is configured so as to provide a touch-less operation of the door member by a user.

8. The security door as recited in claim 7, wherein the switch module is configured to utilize photo sensors to detect a human hand proximate thereto.

9. The security door as recited in claim 8, and further including a first and second camera modules, said first camera module integrally mounted in the door member on the first side of the door member, said second camera module integrally mounted in the door member on the second side of the door member, said first camera module and said second camera module being operably coupled to said controller and further configured to transfer photographic images thereto.

10. The security door as recited in claim 9, wherein the door member further includes a power supply, said power supply configured to provide power for operation of the security door in an event wherein power from the building is interrupted.

11. The security door as recited in claim 10, and further including a network module, said network module being integrally mounted in said door member, said network module operably coupled to the communications network in the building via a communications cable.

12. The security door as recited in claim 11, wherein the door member is mounted to the doorway utilizing hinges, said hinges being electromechanical hinges that are operably coupled to said controller, said electromechanical hinges operable to move the door member to an open position ensuing verification from said controller.

* * * * *